US007909703B1

(12) United States Patent
Semrau et al.

(10) Patent No.: US 7,909,703 B1
(45) Date of Patent: Mar. 22, 2011

(54) CHILD'S BOUNCE TOY WITH SAFETY NET

(76) Inventors: Charlotte Semrau, McKinney, TX (US); Amanda Richtor, McKinney, TX (US)

( * ) Notice: Subject to any disclaimer, the term of this patent is extended or adjusted under 35 U.S.C. 154(b) by 304 days.

(21) Appl. No.: 12/228,935

(22) Filed: Aug. 18, 2008

Related U.S. Application Data

(60) Provisional application No. 60/965,060, filed on Aug. 17, 2007.

(51) Int. Cl.
*A63G 23/00* (2006.01)
*A63B 5/11* (2006.01)

(52) U.S. Cl. ..... 472/135; 482/27; 446/487

(58) Field of Classification Search ..... 472/135, 472/136; 446/476–478, 487; 5/101–107; 482/26–31, 35, 36
See application file for complete search history.

(56) References Cited

U.S. PATENT DOCUMENTS 2,636,314 A * 4/1953 Martinez ..... 446/477
3,886,607 A * 6/1975 Dunn ..... 5/104
D347,121 S 5/1994 Harper et al.
D370,958 S 6/1996 Rash
5,575,530 A 11/1996 Harper et al.
5,584,571 A * 12/1996 Chandler et al. ..... 362/295
5,857,944 A 1/1999 Cone et al.
5,863,097 A 1/1999 Harper et al.
6,138,701 A * 10/2000 Zheng ..... 135/125
6,594,840 B2 7/2003 Tomas et al.
6,607,421 B1 * 8/2003 Rossi ..... 446/478
D503,289 S 3/2005 Eyman et al.
D507,121 S 7/2005 Eyman et al.
D507,891 S 8/2005 Eyman et al.
7,060,001 B2 * 6/2006 Publicover ..... 482/27

* cited by examiner

*Primary Examiner* — Kien T Nguyen
(74) *Attorney, Agent, or Firm* — Montgomery Patent and Design; Robert C. Montgomery

(57) ABSTRACT

A trampoline apparatus with an attached safety net for use by young children of toddler age that provides them with the ability to stand on the apparatus and bounce up and down on their feet is herein disclosed. The apparatus does not allow a child to flip or jump through the air as do conventional trampolines. The safety bounce apparatus is approximately two (2) to three (3) feet in diameter and is supported with a bouncing surface six (6) inches from the floor. The apparatus provides the child with grasping handles and safety net sides being affixed thereto a plurality of vertical extension rods attached to a padded upper ring. An entry/exit opening is provided in the vertical configuration and is secured with hook-and-loop fastening means. The complete apparatus may be disassembled for storage and transporting and includes a handled carrying case.

16 Claims, 7 Drawing Sheets

CHILD'S BOUNCE TOY WITH SAFETY NET

RELATED APPLICATIONS

The present invention was first described in and claims the benefit of U.S. Provisional Application No. 60/965,060 filed on Aug. 17, 2007, the entire disclosures of which are incorporated herein by reference.

FIELD OF THE INVENTION

The present invention relates generally to a safety bouncing toy therefor a child comprising a bouncing platform surrounded by a padded and mesh safety enclosure and accessible therewith an access gate suspended thereabove a base unit, wherein said bouncing toy provides an illumination means whenever a control sensor senses a bouncing motion thereof said bouncing platform.

BACKGROUND OF THE INVENTION

Children enjoy bouncing on objects. Whether bouncing on a bed or even on a hard floor, children just seem to love it. Of course as with most things children like to do, there is an element of risk involved. Children can fall off of beds and can hit their head and chin on chairs or end tables they may be holding while bouncing. An apparatus specifically made for bouncing, the trampoline, just isn't practical for use by young children such as toddlers, as it introduces additional safety worries. Accordingly, there exists a need for a means by which young children can bounce in a controlled manner while still remaining safe and free from injury. The development of the child bouncing toy with safety net fulfills this need.

U.S. Pat. No. 6,594,840 issued to Tomas et al. discloses a bassinet and bouncer combination. Unfortunately, this patent does not appear to disclose a child's bounce toy with safety net.

U.S. Pat. No. 5,863,097 issued to Harper and Bertsch discloses an infant carrier with a bounce function. Unfortunately, this patent does not appear to disclose a child's bounce toy with a safety net.

U.S. Pat. No. 5,857,944 issued to Cone and Rosko discloses a stationary baby jumper that appears to be a jumper seat for toddlers mounted on a frame. Unfortunately, this patent does not appear to disclose a child's bounce toy with a safety net.

U.S. Pat. No. 5,575,530 issued to Harper and Bertsch discloses an infant carrier with a bouncer mode of operation. Unfortunately this patent does not appear to disclose a child's bounce toy with a safety net.

U.S. Pat. No. D 347,121 issued to Harper discloses an infant bouncer. This design patent does not appear to be similar in appearance to the disclosed invention nor does it appear to disclose a trampoline apparatus for use by young children that possesses a safety net and motion activated lights.

U.S. Pat. No. D 370,958 issued to Rash discloses a child bungee bouncing toy. This design patent does not appear to be similar in appearance to the disclosed invention nor does it appear to disclose a trampoline apparatus for use by young children that possesses a safety net and motion activated lights.

U.S. Pat. Nos. D 503,289, D 507,121 and D 507,891 issued to Eyman and Schmidlin disclose baby bouncers. These design patents do not appear to be similar in appearance to the disclosed invention nor do they appear to disclose a trampoline apparatus for use by young children that possesses a safety net and motion activated lights.

SUMMARY OF THE INVENTION

In light of the disadvantages in the prior art, it is apparent that there is a need for a novel trampoline with an attached safety net for use by young children of toddler age that provides them with the ability to bounce and does not allow a child to flip or jump through the air.

An object of the child's bounce toy with safety net provides young children of toddler age with the ability to stand and bounce up and down on their feet.

Another object of the child's bounce toy with safety net is that it does not allow a child to flip or jump through the air as do conventional trampolines.

A further object of the child's bounce toy with safety net is that the apparatus forms a circular enclosure of approximately two (2) to three (3) feet in diameter and is laterally stabilized using a flat base.

Still a further object of the child's bounce toy with safety net is safety net sides which extend vertically approximately twenty-eight (28) to thirty-six (36) inches above the bouncing surface.

Yet another object of the child's bounce toy with safety net provides battery powered lighting which flashes on and off as the child jumps up and down. The flashing light units having particular entertaining lighting effects providing a variety of illuminating characteristics such as, but not limited to: duration, brightness, number of flashes, and the like, based upon embedded software within the control module. The flashing light units are provided in a variety of colors.

Still another object of the child's bounce toy with safety net provides an apparatus that can be disassembled for storage or transporting and includes a handled carrying case.

Yet still another object of the child's bounce toy with safety net is a frame portion made of soft plastic tubes approximately one (1) to two (2) inches in diameter that are manufactured in a variety of decorative and attractive colors and patterns.

Another object of the child's bounce toy with safety net is a carrying case made of vinyl, canvas, or equivalent flexible waterproof and rugged materials in a variety of attractive colors and patterns.

Still a further object of the child's bounce toy with safety net is that constant DC electric current is supplied to the apparatus by rechargeable or disposable batteries.

Yet another object of the child's bounce toy with safety net is that the battery powered lights are controlled by a motion switch that activated by vibrations from a bouncing motion.

Still a further object of the child's bounce toy with safety net comprises a cylindrical frame portion to contain and protect an occupying infant or toddler.

Yet still a further object of the child's bounce toy with safety net is padding may be applied to various surfaces of the apparatus as needed to create a safe environment for an occupying child and as such should not be interpreted as a limiting factor of the invention.

An aspect of the child's bounce toy with safety net comprises four (4) vertical extension rods, a top rail, a bottom rail, a bouncing surface, a rear panel, a pair of safety net side panels, a net gate, a plurality of snap fasteners, and a plurality of hook-and-loop fasteners. The vertical extension rods, top rail, and bottom rail provide secure attachment of the bouncing surface, the rear panel the safety net side panels, and the net gate via a plurality of snap fasteners and hook-and-loop fastener strips.

Another aspect of the child's bounce toy with safety net comprises a frame portion comprising a plurality of vertical extension rods, a transport handle, a top rail, a bottom rail, and a base platform. The frame and base platform portions are envisioned being made using a strong light-weight plastic material such as polypropylene, acrylonitrile butadiene styrene (ABS), or the like, thereby providing safety to an occupying child while providing a strong and sturdy structure.

A further aspect of the child's bounce toy with safety net comprises vertical extension rods comprising four (4) tubular members made of said soft plastic being positioned in a vertical orientation and providing a secure attachment at top end portions to a circular or elliptical top rail by top rail sockets integrally molded into the top rail. The vertical extension rods provide an attachment means to a bottom rail. The vertical extension rods also provide an attachment means to a base platform by base sockets integrally molded in said base platform. The vertical extension rods are inserted into and affixed to the sockets using common threaded mechanical fasteners.

Yet another aspect of the child's bounce toy with safety net comprise a top rail comprises a generally elliptical perimeter shape when viewed from above envisioned to be contoured downwardly at a proximal end to aid loading and unloading of a child. The top rail is further envisioned to slope upwardly at a distal end and providing attachment of a transport handle along an upper surface.

A further aspect of the child's bounce toy with safety net comprises a frame portion further comprising four (4) flashing light units, a control module, interconnecting wiring, and a motion switch.

Another aspect of the child's bounce toy with safety net comprises four (4) flashing light units illuminated in a synchronous fashion with a bouncing motion of the child by activation of a motion switch mounted to a vertical extension rod. The lighting system comprises four (4) flashing light units similar to popular rope-lighting. The flashing light units comprise a string of electrically connected lamps such as incandescent, or light emitting diode (LED) lamps. The flashing light units are permanently affixed to the vertical extension rods providing illumination which is visible inside and outside the apparatus. Each flashing light unit further comprises a connecting wire having a male connector providing an electrical connection means to the control module. The male connector comprises a common three (3) conductor blade or pin-type connector.

Still another aspect of the child's bounce toy with safety net comprises a motion switch that is an impact type switch closure.

Yet another aspect of the child's bounce toy with safety net comprises a bouncing surface comprising a taut circular textile shape being suspended approximately six (6) inches above the base platform and made of an expanding material similar to that of a conventional trampoline surface. The bottom rail portion provides an attachment means thereto the bouncing surface.

A further aspect of the child's bounce toy with safety net comprises a rear panel comprises a flat flexible plastic surface providing additional stability for children of differing height and is attached to vertical extension rods, the top rail, and the bottom rail. The rear panel comprises a pair of horizontal "U"-shaped grasping handles arranged vertically thereupon said rear panel allowing children of different heights to stabilize themselves during bouncing. The grasping handles further comprise extra padding material along an outer surface envisioned to be made using a dense urethane foam-rubber material to protect a child. The rear panel further comprises a semi-circular rear panel opening providing visibility to the child and an additional upper grasping edge.

Still a further aspect of the child's bounce toy with safety net comprises safety net side panels located along each side area comprise an expanding open mesh fabric surface providing the child with a safety means if contacted during use. The safety net provides an attachment means to the vertical extension rods, the top rail, and the bottom rail using common snap fasteners.

Still another aspect of the child's bounce toy with safety net comprises a gate that provides an opening for entrance and exit and is located between the pair of vertical extension rods located at a proximal end of the apparatus. The gate is affixed to the top rail, bottom rail, and a right side vertical extension rod using common hook-and-loop fastening methods for easy access.

A further aspect of the child's bounce toy with safety net comprises a transport handle that provides a convenient means to move the apparatus. The transport handle is made using a flexible plastic or nylon strap material affixed to the top rail. The top rail further comprises extra padding material to protect the child from harmful impact.

Another aspect of the child's bounce toy with safety net comprises a base that comprises a flat panel having a round or elliptical perimeter being approximately one-half (½) inch thick with a diameter of approximately forty-eight (48) to sixty (60) inches being of sufficient size so as to provide lateral stability to the apparatus during use and provides four (4) integrally molded mounting base sockets providing an attachment means thereto the vertical extension rod portions of the framed structure being secured thereto using common fasteners such as screws, bolts, or the like.

A further aspect of the child's bounce toy with safety net comprises a control module that provides electronic control of the flashing light units. The control module comprises a common plastic housing providing a protective enclosure to electrical and electronic components required to control the flashing light units such as printed circuit boards, microprocessors, embedded software, output drivers, relays, and the like. The control module further comprises four (4) mounting apertures, four (4) female connectors, and a battery compartment. The mounting apertures comprise counter-bored holes providing a secure mounting means to the base platform. The female connectors provide an electrical connection means with the male connector portions of the flashing light units. The control module receives DC power from one (1) or more rechargeable or disposable batteries located within the battery compartment with access by an integral flush-mounted and removable cover.

Still another aspect of the child's bounce toy with safety net comprises a carrying case that provides a weatherproof transportation means to the apparatus comprising a cylindrical carrying case enclosure, a carrying case top cover, a carrying case handle, and a zipper. The carrying case enclosure provides a perimeter shape being slightly larger than that of the base platform, thereby providing a snug fit thereto the disassembled apparatus. The carrying case enclosure further provides an attachment means to a plastic or nylon strap-type handle along a side portion and an attachment means to the carrying case top cover along an upper perimeter edge via a common heavy-duty zipper which is envisioned to extend around a majority perimeter portion of the carrying case enclosure allowing access thereto an inner space thereof enabling easy loading of the disassembled apparatus portions. The carrying case enclosure utilizes conventional textile industry assembly techniques comprising pre-cut and sewn panels forming a shallow cylinder-shaped container.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
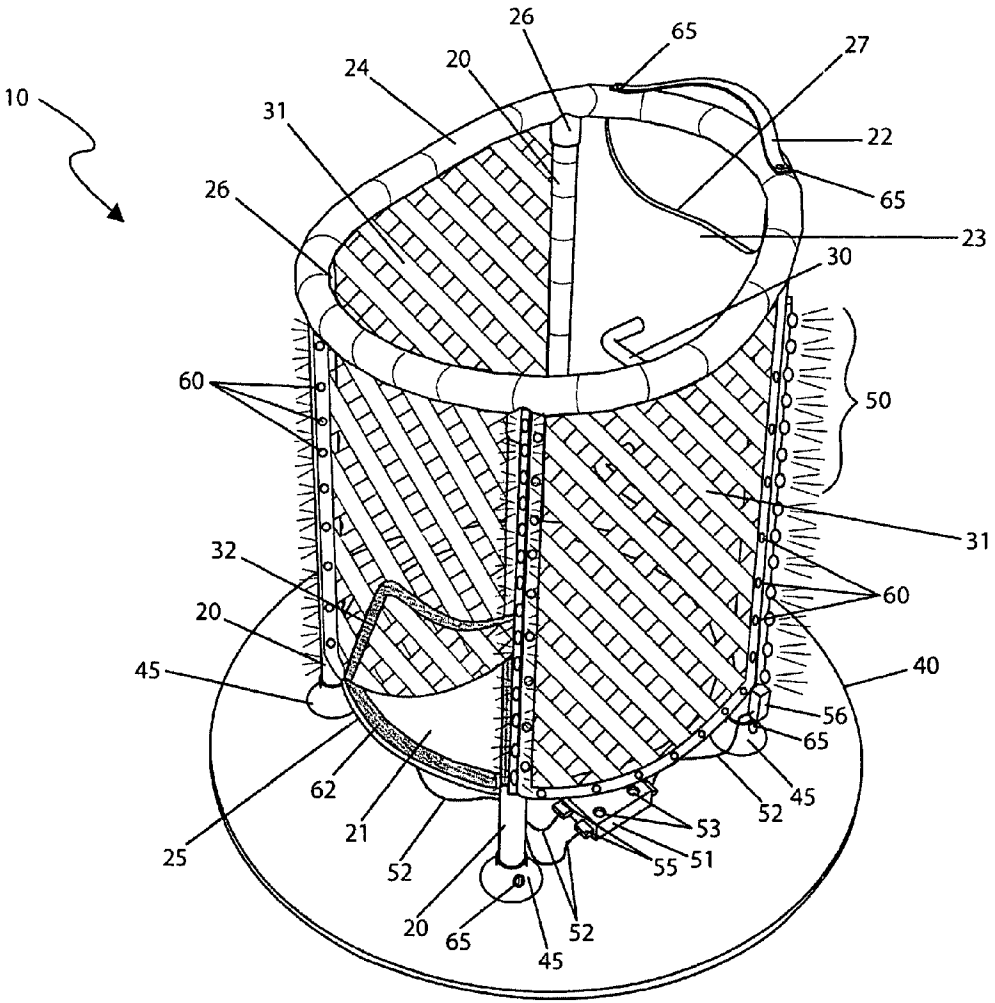
FIG. 1 is a side perspective view of a child's bounce toy with safety net 10, according to a preferred embodiment of the present invention.

| | |
|---|---|
| 10 | child's bounce toy with safety net |
| 20 | vertical extension rod |
| 21 | bouncing surface |
| 22 | transport handle |
| 23 | rear panel |
| 24 | top rail |
| 25 | bottom rail |
| 26 | top rail socket |
| 27 | rear panel opening |
| 28 | padding |
| 30 | grasping handle |
| 31 | safety net side panel |
| 32 | gate |
| 40 | base platform |
| 45 | base socket |
| 50 | flashing light unit |
| 51 | control module |
| 52 | wiring |
| 53 | mounting aperture |
| 54 | female connector |
| 55 | male connector |
| 56 | motion switch |
| 57 | battery compartment |
| 58 | battery |
| 60 | snap fastener |
| 62 | hook-and-loop fastener |
| 65 | common fastener |
| 67 | fastener aperture |
| 70 | carrying case assembly |
| 72 | carrying case enclosure |
| 74 | carrying case top cover |
| 76 | carrying case handle |
| 78 | zipper |

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a child's bounce toy with safety net (herein described as the "apparatus") 10, which provides young children of toddler age with the ability to stand on an apparatus 10 and bounce up and down on their feet. It does not allow a child to flip or jump through the air as do conventional trampolines. The apparatus 10 forms a circular enclosure of approximately two (2) to three (3) feet in diameter and is laterally stabilized using a flat base 40 approximately six (6) inches below a bouncing surface 21. Safety net sides 31 are provided which extend vertically approximately twenty-eight (28") to thirty-six (36") inches above the bouncing surface 21 being affixed thereto a tubular frame using snap fasteners 60 and hook-and-loop fastener strips 62. A detachable entry/exit opening or gate 32 is also provided along one (1) side being secured using said hook-and-loop fasteners 62. The apparatus 10 also provides battery powered lighting 50 which flashes on and off as the child jumps up and down. The complete apparatus 10 can be disassembled for storage or transporting and includes a handled carrying case 70.

Figure 2A:
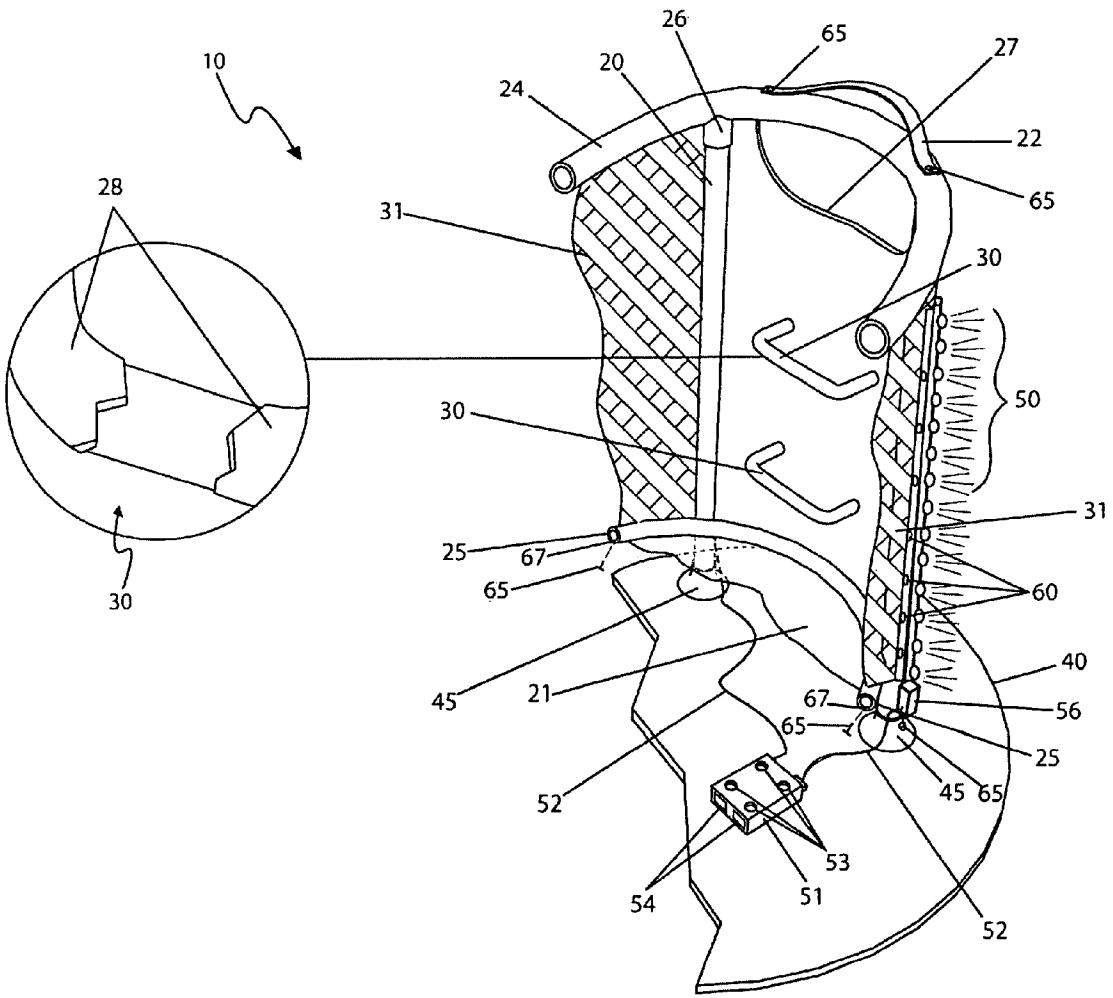
FIG. 2*a* is a cut-away view of the child's bounce toy with safety net 10, according to a preferred embodiment of the present invention.
Figure 2B:
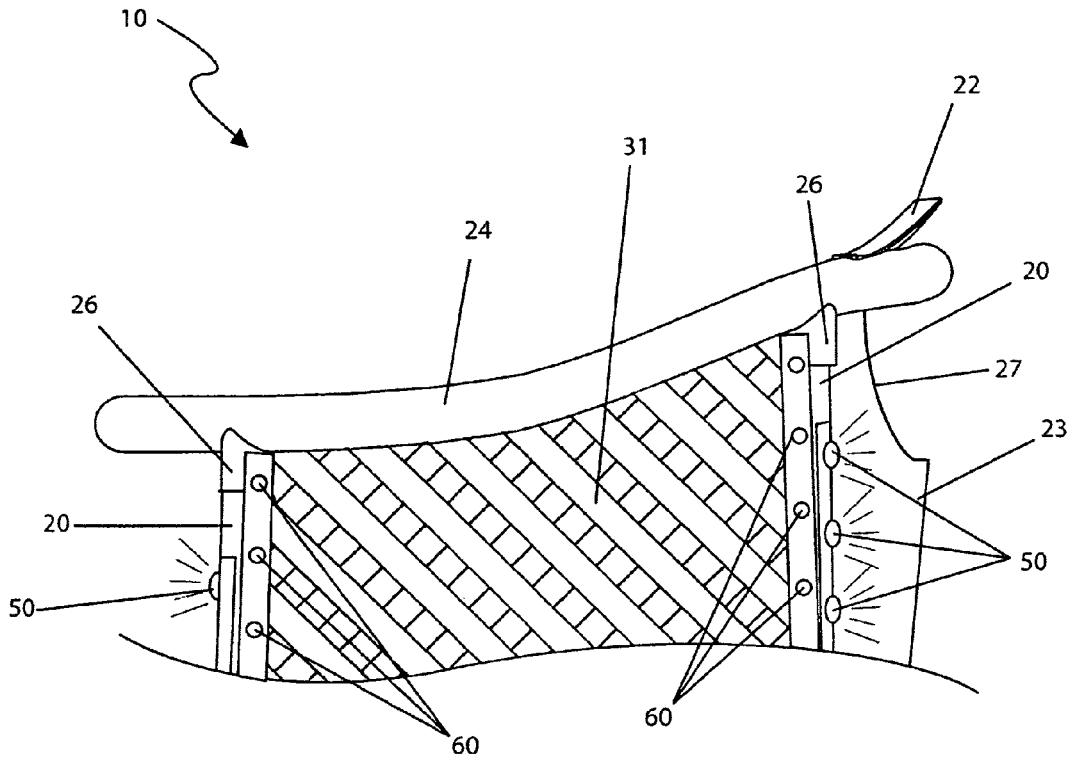
FIG. 2*b* is a side view of a top rail portion 24 of the child's bounce toy with safety net 10, according to a preferred embodiment of the present invention.

Referring now to FIGS. 1, 2*a* and 2*b*, side, perspective, and cut-away views of the apparatus 10, according to the preferred embodiment of the present invention, are disclosed. The apparatus 10 comprises a cylindrical frame structure to contain and protect an occupying infant or toddler therewithin. The frame portion of the apparatus 10 is envisioned to be made using soft plastic tubes approximately one (1) to two (2) inches in diameter being introduced in a variety of decorative and attractive colors and patterns (see FIG. 3). The apparatus 10 comprises four (4) vertical extension rods 20, a top rail 25, a bottom rail 25, a bouncing surface 21, a rear panel 23, a pair of safety net side panels 31, a net gate 32, a plurality of snap fasteners 60, and a plurality of hook-and-loop fasteners 62. The vertical extension rods 20, top rail 24, and bottom rail 25 provide secure attachment of the rear panel 23, the safety net side panels 31, and the net gate 32 via a plurality of snap fasteners 60 and hook-and-loop fastener strips 62 affixed along outwardly facing surfaces of said frame members using common fasteners 65 and adhesives (see FIG. 3). The frame portion of the apparatus 10 further comprises four (4) flashing light units 50, a control module 51, interconnecting wiring 52, and a motion switch 56. The bouncing surface 21 comprises a taut circular textile shape being suspended approximately six (6) inches above the base platform 40 and made of an expanding material similar to that of a conventional trampoline surface. The bottom rail portion 25 provides an attachment means thereto the bouncing surface 21 being stretched and wrapped therearound a bottom surface of said bottom rail 25 and being secured thereto via a plurality of equal-spaced common threaded fasteners 65 such as screws and corresponding drilled fastener apertures 37. The rear panel 23 comprises a flat flexible plastic surface providing additional stability for children of differing height and is attached along side edges thereto two (2) vertical extension rods 20, the top rail 24, and the bottom rail 25 using common snap fasteners 60. The rear panel 23 comprises at least a pair of horizontal "U"-shaped grasping handles 30 arranged vertically thereupon said rear panel 23 allowing children of different heights to stabilize themselves during bouncing. The grasping handles 30 further comprise extra padding material 28 along an outer surface envisioned to be made using a dense urethane foam-rubber material being bonded thereto an inner plastic tube using common adhesives, thereby protecting the child from harmful impact. The rear panel 23 further comprises a semi-circular rear panel opening 27 along an upper edge thereof providing visibility thereto the child as well as an additional upper grasping edge. The safety net side panels 31 along each side area comprise an expanding open mesh fabric surface providing the child with a safety means if contacted during use. The safety net 31 provides an attachment means thereto the vertical extension rods 20, the top rail 24, and the bottom rail 25 using common snap fasteners 60. The gate 32 provides an entrance and exit means thereto the child and is located therebetween the pair of vertical extension rods 20 located thereat a proximal end of the apparatus 10 and are envisioned to be of similar materials and construction as the aforementioned safety net side panels 31; however, the gate 32 is affixed thereto the top rail 24, bottom rail 25, and a right side vertical extension rod 20 using common hook-and-loop fastening 62 methods for easy access therethrough. The apparatus 10 further comprises a flashing light system which provides an electronic means to activate four (4) flashing light units 50 being illuminated in a synchronous fashion therewith a bouncing motion of the child via activation of a motion switch 56 mounted thereto a lower portion of one (1) vertical extension rod 20. Said lighting system comprises four (4) flashing light units 50 being similar to popular rope-lighting and being approximately twenty-four (24) inches long. The flashing light units 50 comprise a string of electrically connected lamps such as incandescent, light emitting diode (LED) lamps, or the like. The flashing light units 50 are permanently affixed thereto outward facing surfaces of the vertical extension rods 20 using common fasteners 65 or adhesives, thereby providing illumination which is visible inside and outside the apparatus 10. The flashing light units 50 are envisioned to be introduced with a variety of lamp colors based upon a user's preference. The motion switch 56 provides an impact type switch closure envisioned to be similar to like devices used in popular children's flashing sneakers. Each flashing light unit 50 further comprises a connecting wire 52 having a male connector 55, thereby providing an electrical connection means thereto the control module 51. The male connector 55 comprises a common three (3) conductor blade or pin-type connector providing standard power, ground, and signal communication therewith the electronic control module 51 (see FIG. 4 for more details).

Figure 3:
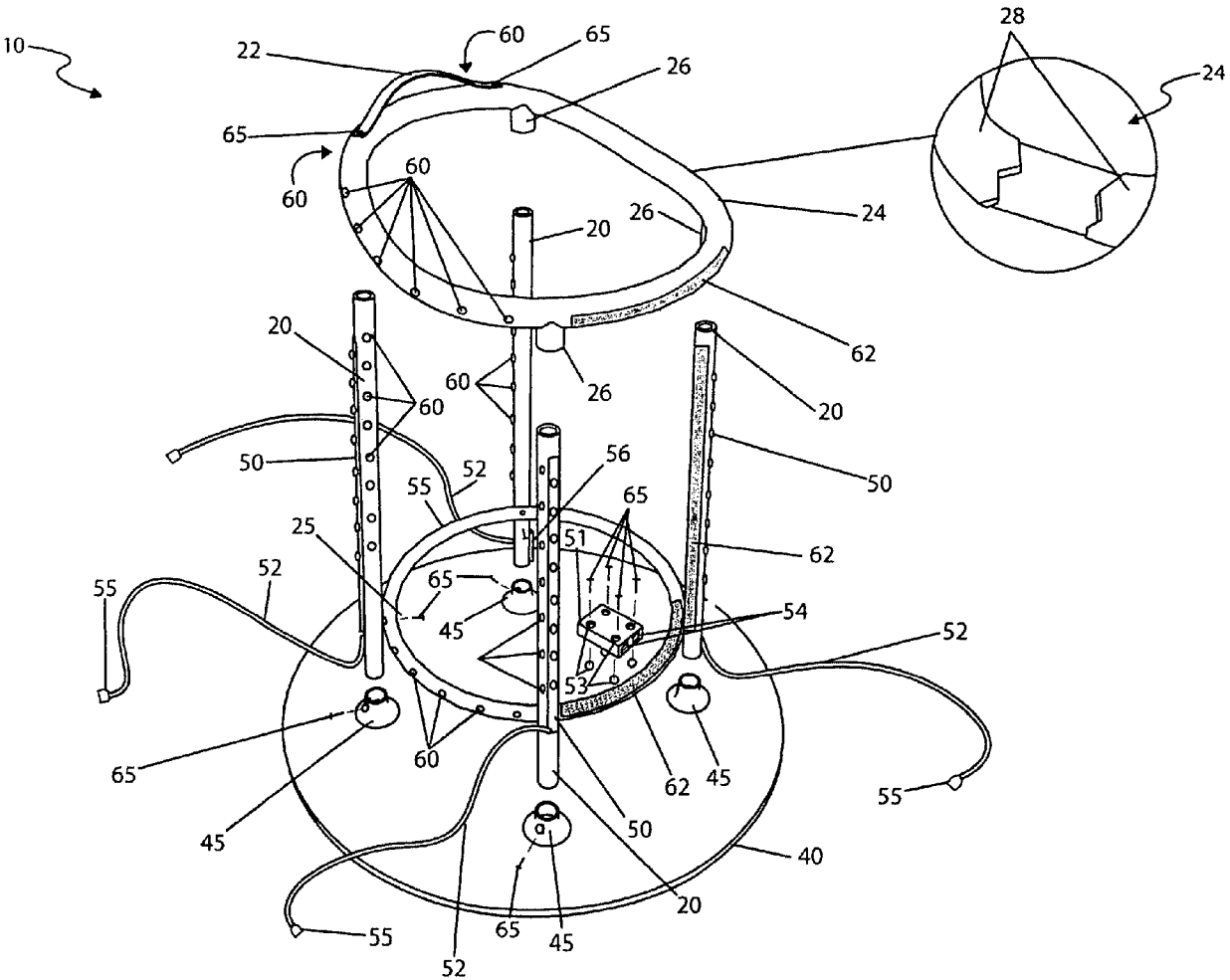
FIG. 3 is an exploded view of a frame portion of the child's bounce toy with safety net 10, according to a preferred embodiment of the present invention.

Referring now to FIG. 3, an exploded view of a frame portion of the apparatus 10, according to a preferred embodiment of the present invention, is disclosed. The frame portion of the apparatus 10 comprises a plurality of vertical extension rods 20, a transport handle 22, a top rail 24, a bottom rail 25, and a base platform 40. Said frame 20, 24, and base platform portions 40 are envisioned being made using a strong lightweight plastic material such as polypropylene, acrylonitrile butadiene styrene (ABS), or the like, thereby providing safety to an occupying child while providing a strong and sturdy structure. The vertical extension rods 20 comprise four (4) tubular members made of said soft plastic being positioned in a vertical orientation and providing a secure attachment at top end portions thereto a top rail 24 via top rail sockets 26 being integrally molded therein said top rail 24. The vertical extension rods 20 are inserted thereinto said top rail sockets 26 using common fasteners 65 such as screws. The vertical extension rods 20 also provide an attachment means thereto a bottom rail 25 being positioned horizontally approximately six (6) inches above the base platform 40 and affixed thereto using like common fasteners 65. The vertical extension rods 20 also provide an attachment means at a bottom end portion thereto a base platform 40 via base sockets 45 being integrally molded therein said base platform 40. The vertical extension rods 20 are inserted thereinto and affixed thereto said sockets 45 using common threaded fasteners 65 such as screws. The top rail 24 comprises a generally elliptical perimeter shape when viewed from above envisioned to be contoured downwardly at a proximal end to aid loading and unloading of a child. The top rail 24 is further envisioned to slope upwardly at a distal end and providing attachment of a transport handle 22 along an upper surface. The transport handle 22 provides a convenient means to relocate or lift the apparatus 10 upon a floor surface in an expected manner. Said transport handle 22 is envisioned being made using a flexible plastic or nylon strap material affixed thereto said top rail 24 using common fasteners 65 such as screws. The top rail 24 further comprises extra padding material 28 to protect the child from harmful impact being similar to the aforementioned grasping handles 30. It is also understood that application of additional padding 28 may be applied thereto various surfaces of the apparatus 10 as needed to create a safe environment for an occupying child and as such should not be interpreted as a limiting factor of the invention 10. The base 40 comprises a flat panel having a round or elliptical perimeter being approximately one-half (½) inch thick with a diameter of approximately forty-eight (48) to sixty (60) inches being of sufficient size so as to provide lateral stability to the apparatus 10 during use and provides four (4) integrally molded mounting base sockets 45 providing an attachment means thereto the vertical extension rod portions 20 of the framed structure being secured thereto using common fasteners 65 such as screws, bolts, or the like.

Figure 4:
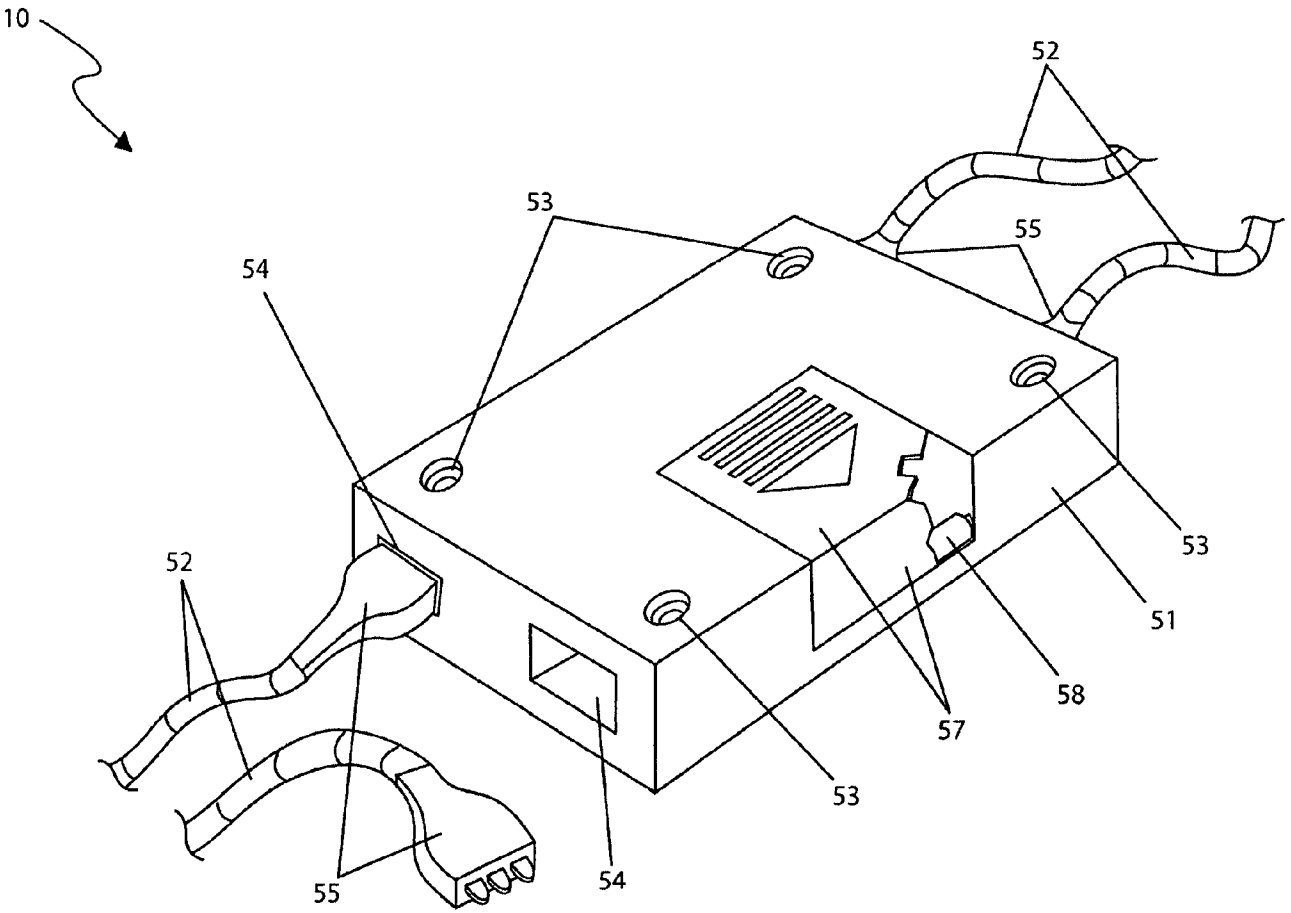
FIG. 4 is a close-up view of a light control module portion 51 of the child's bounce toy with safety net 10, according to a preferred embodiment of the present invention.

Referring now to FIG. 4, a close-up view of a light control module portion 51 of the child's bounce toy with safety net 10, according to a preferred embodiment of the present invention, is disclosed. The control module 56 provides electronic control of the four (4) flashing light units 50. The control module 56 comprises a common plastic housing providing a protective enclosure thereto electrical and electronic components required to control the flashing light units 50 such as printed circuit boards, microprocessors, embedded software, output drivers, relays, and the like. It is understood that the flashing light units 50 may provide any number of illumination sequences and patterns thereupon activation based upon embedded software within the control module 51 and therefore should not be interpreted as a limiting factor of the invention 10. The control module 56 further comprises four (4) mounting apertures 53, four (4) female connectors 54, and a battery compartment 57. The mounting apertures 53 comprise counter-bored holes providing a secure mounting means thereto the base platform 40 using common threaded fasteners 65 such as screws, bolts, or the like. The female connectors 54 provide an electrical connection means therewith the aforementioned male connector portions 55 of the flashing light units 50. The control module 51 receives DC power therefrom one (1) or more rechargeable or disposable batteries 58 therewithin the battery compartment 57 providing access thereinto via an integral flush-mounted and removable cover.

Figure 5:
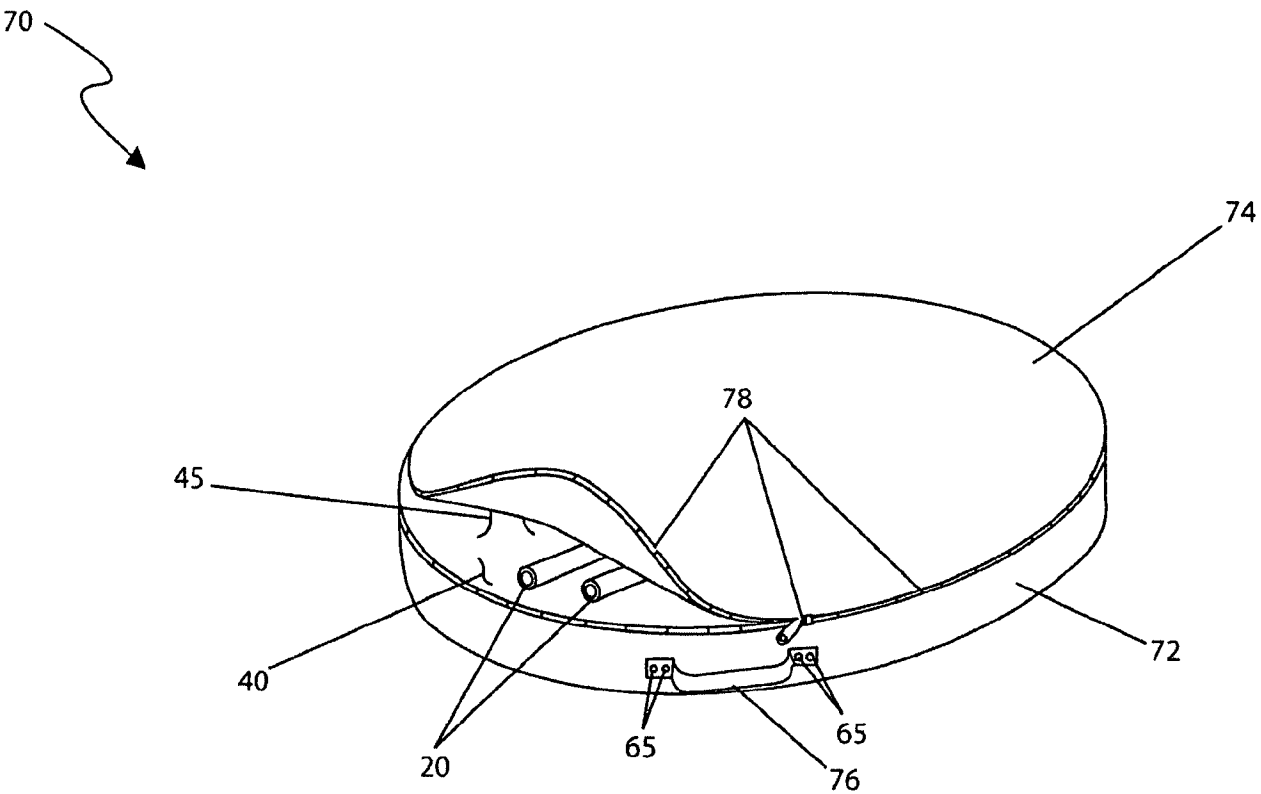
FIG. 5 is a perspective view of a carrying case portion 70 of the child's bounce toy with safety net 10, according to a preferred embodiment of the present invention; and, FIG. 6 is an electrical block diagram of the light control portion of the child's bounce toy with safety net 10, according to a preferred embodiment of the present invention.

Referring now to FIG. 5, a perspective view of a carrying case portion 70 of the child's bounce toy with safety net 10, according to a preferred embodiment of the present invention, is disclosed. The carrying case 70 provides a weatherproof transportation means thereto the apparatus 10 comprising a cylindrical carrying case enclosure 72, a carrying case top cover 74, a carrying case handle 76, and a zipper 78. The carrying case enclosure 72 provides a shallow shape having a perimeter being slightly larger than that of the base platform 40 with a depth of approximately six (6) to ten (10) inches, thereby providing a snug fit thereto the disassembled apparatus 10. The carrying case enclosure 72 further comprises a flat bottom panel having side portions extending upwardly all around at right angles therefrom. The carrying case enclosure 72 further provides an attachment means thereto a plastic or nylon strap-type handle 76 along a side portion via a plurality of common fasteners 65 such as rivets. The carrying case enclosure 72 further provides an attachment means thereto the carrying case top cover 74 along an upper perimeter edge via a common heavy-duty zipper 78 which is envisioned to extend around a majority perimeter portion of the carrying case enclosure 72 allowing access thereto an inner space thereof enabling easy loading of the disassembled apparatus 10 portions. The carrying case enclosure 72 utilizes conventional textile industry assembly techniques comprising precut and sewn panels forming a shallow cylinder-shaped container. The carrying case enclosure 72 is envisioned being made of vinyl, canvas, or equivalent flexible waterproof and rugged materials being introduced in a variety of attractive colors and patterns.

Figure 6:
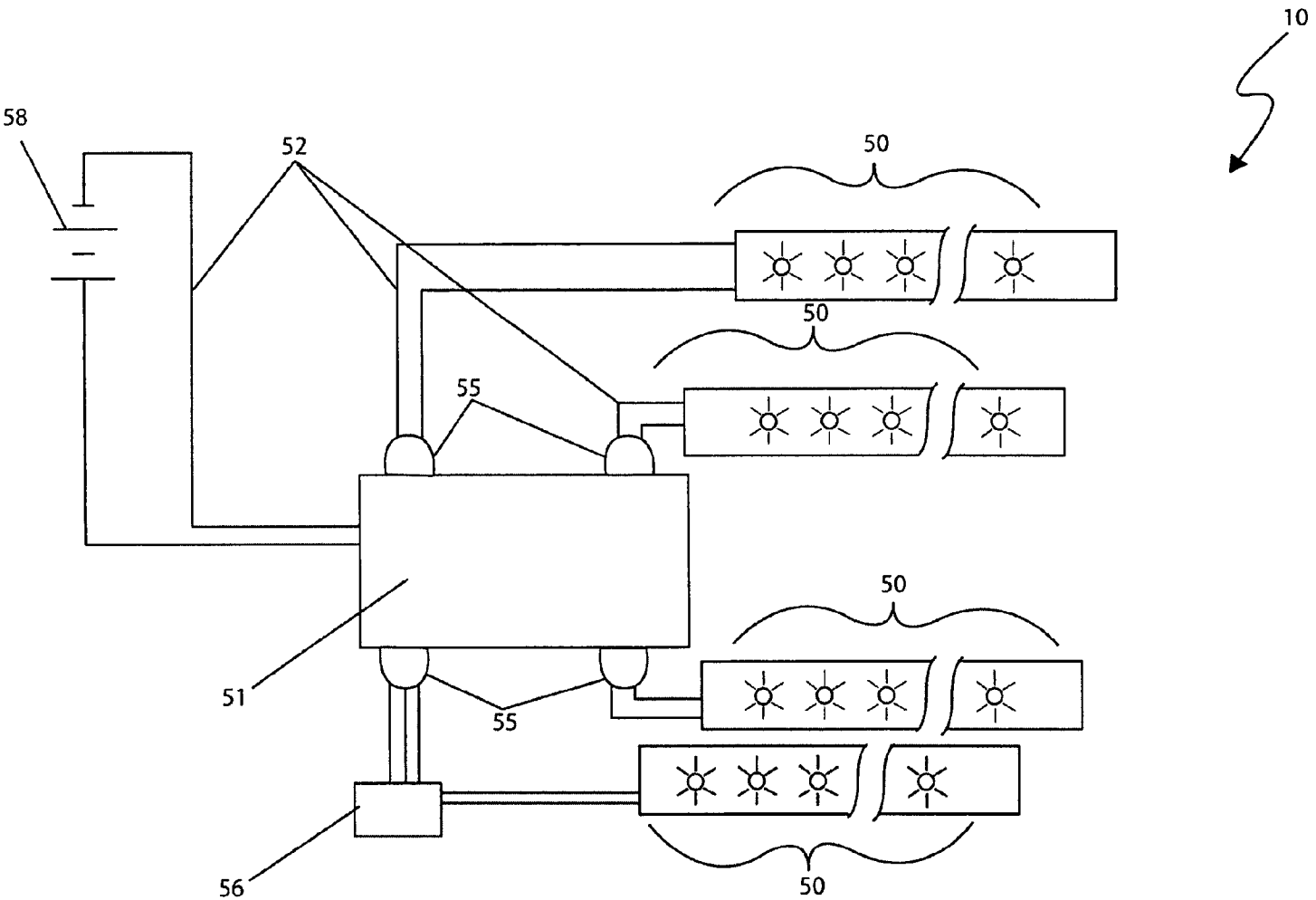

Referring now to FIG. 6, an electrical block diagram of the light control portion of the apparatus 10, according to a preferred embodiment of the present invention, is disclosed. A constant DC electric current is supplied thereto the control module portion 51 of the apparatus 10 via one (1) or more rechargeable or disposable batteries 58 and corresponding interconnecting wiring 52. During use of the apparatus 10, the control module 51 receives an input signal therefrom the motion switch 56 resulting from vibrations transmitted therefrom a bouncing motion. The control module 51 in-turn conducts a current thereto the flashing light units 50 having particular entertaining lighting effects providing a variety of illuminating characteristics such as, but not limited to: duration, brightness, number of flashes, and the like, based upon embedded software within the control module 51.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1, 2*a*, and 2*b*.

The method of installing and utilizing the apparatus 10 may be achieved by performing the following steps: unpacking the apparatus 10 therefrom the carrying case 70 using the zipper portion 78; placing the base 40 on a flat surface; assembling the vertical extension rods 20 thereto the base socket portions 45 of the base 40 using provided fasteners 65; assembling the bottom rail 25 thereto the vertical extension rods 20 via the provided fasteners 65; inserting and fastening the top rail 24 thereto the vertical extension rods 20 using the top rail socket portions 26 and provided fasteners 65; assembling the rear panel 23 thereto the vertical extension rods 20 using the snap fasteners 60; attaching the safety net 31 and gate 32 portions thereto the vertical extension rods 20, top rail 24, and bottom rail 25 portions using the snap fasteners 60; assembling the control box 51 thereto the base 40 using the mounting apertures 53 and corresponding fasteners 65; connecting the male connector portions 55 of the flashing light units 50 thereinto the female connector portions 54 of the control module 51; installing a fresh set of batteries 58 thereinto the battery compartment 57; placing the child into the apparatus 10 or allowing the child to enter the gate portion 31; closing the safety gate 31 securely by attaching the hook-and-loop fasteners 62 thereto the vertical extension rod 20, top rail 24, and bottom rail 25; encouraging the child to use the grasping handles 30 to establish a secure stance thereupon the bouncing surface 21; encouraging the child to bounce thereagainst said bouncing surface 21, thereby activating the motion switch 56 and subsequent flashing light units 50, thereby providing an attractive lighting effect; disassembling the apparatus 10 after use and storing same therewithin the carrying case 70 until again needed; and, enabling a child or toddler to enjoy a safe and entertaining trampoline-like experience while using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A child's bounce toy further comprising:

a safety enclosure, further comprising a cylindrical frame structure comprising tubular frame elements further comprising:

four vertical extension rods, each comprising a top end and a bottom end;

a top rail providing an upper secure attachment means to each of said four vertical extension rods and having a elliptical configuration;

a bottom rail attachable thereto a lower portion thereof each of said four vertical extension rods and providing a bouncing surface secure attachment means to a bouncing surface;

said bouncing surface comprising a taut circular shape thereof an expanding material being suspended above a base platform and securely attached to said bottom rail with said bouncing surface secure attachment means;

a rear panel comprising a flexible material attached along side edges to a rear pair of said four vertical extension rods, along a bottom edge to said bottom rail, and along a top edge to a distal end of said top rail with a plurality of panel fasteners;

a pair of safety net side panels comprising an expanding open mesh fabric surface each attached along both side edges to opposing one rear vertical extension rod and one front vertical extension rod, along a bottom edge to said bottom rail, and along a top edge to said top rail with said plurality of panel fasteners; and, a net gate located between a front pair of said four vertical extension rods comprising an expanding open mesh fabric surface attached along one side edge to one of said front pair of vertical extension rods with said plurality of panel fasteners and along an opposing one of said front pair of vertical extension rods, along a bottom edge to said bottom rail, and along a top edge to a proximal end of said top rail with a gate fastener;

wherein said bottom rail is positioned horizontally parallel to said base platform at a pre-determined height;

wherein said four vertical extension rods, said top rail, and said bottom rail are attached to provide a structural rigidity of said cylindrical frame structure;

wherein said rear panel, pair of safety net panels, and net gate provides an additional safety means for users of differing height;

wherein said net gate provides an entrance and exit means to said safety enclosure;

said bouncing surface forming a bottom portion of said safety enclosure;

said base platform providing a laterally stabilizing means to said safety enclosure;

an illumination means attached to said safety enclosure activated by a bouncing motion thereby a user; and, a carrying case for storing a disassembled configuration of said toy;

wherein said safety enclosure contains and protects a user therewithin;

wherein said bounce toy provides a modular assembly means enabling said toy to be easily disassembled into said disassembled configuration for storage or transporting in said carrying case.

2. The bounce toy of claim 1, wherein said upper secure attachment means further comprises four top rail sockets integrally molded of said top rail for receiving said top end of each of said four vertical extension rods;

wherein each of said four vertical extension rods are secured within said four (4) top rail sockets with a fastening means.

3. The bounce of toy of claim 1, comprising a lower secure attachment means further comprising four base sockets integrally molded in said base platform for receiving said bottom end of each of said four vertical extension rods;

wherein each of said four vertical extension rods are secured within said four base sockets with a fastening means.

4. The bounce toy of claim 1, wherein said top rail comprises a generally elliptical perimeter shape of a tubular construction when viewed from above and further comprising:

said proximal end comprising a proximal height;

said distal end comprising a distal height that slopes upwardly from said proximal end; and, a handle portion affixed to an upper surface of said top rail at said distal end;

wherein said proximal height provides a means for easily placing said user in and removing said user from said safety enclosure.

5. The bounce toy of claim 1, wherein said base platform comprises a similar cross-sectional shape thereof and a diameter or width equal to or greater than said safety enclosure.

6. The bounce toy of claim 1, wherein said rear panel further comprises:

at least a pair of grasping handles arranged vertically upon an inner surface thereof said rear panel comprising padding material bonded or attached to an outer circumference, thereby providing users of different heights means to stabilize and protect themselves during said bouncing motion; and, a semi-circular rear panel opening along an upper edge of said rear panel, thereby providing visibility to said user and providing an additional upper grasping edge.

7. The bounce toy of claim 1, wherein said plurality of panel fasteners comprises snap fasteners.

8. The bounce toy of claim 1, wherein said gate fastener comprises a hook-and-loop-type fastener.

9. The bounce toy of claim 1, wherein said cylindrical frame structure and said base platform comprise a strong light-weight plastic material of construction, thereby providing safety to said user while providing a strong and sturdy structure.

10. The bounce toy of claim 6, further comprising extra padding material encircling said top rail to protect said user from harmful impact.

11. The bounce toy of claim 1, wherein said cylindrical frame structure comprises approximately one to two inches in diameter, said safety enclosure comprises approximately two to three feet in diameter or width, said base platform comprises approximately four to five feet in diameter or width.

12. The bounce toy of claim 1, wherein said illumination means further comprises:

a motion switch mounted to a lower portion of one of said four vertical extension rods and further comprising an impact type switch;

a control module in electrical communication said motion switch; and, four (4) flashing light units each affixed in a vertical orientation to an outer surface of each of said four (4) vertical extension rods and each in electrical communication said control module;

wherein each of said four flashing light units do not interfere with said plurality of panel fasteners or said gate fastener;

wherein said bouncing motion activates said motion switch and sends an illumination signal to said control module;

wherein said control module provides an electronic control of said illumination signal to each of said four (4) flashing light units; and, wherein said four (4) flashing light units are illuminated in a synchronous fashion via activation of said motion switch.

13. The bounce toy of claim 12, wherein said control module further comprises:

a plastic housing providing a protective enclosure to internal electrical and electronic components;

four mounting apertures for providing a secure mounting means of said control module to said base platform with fasteners;

four female connectors for providing said electrical communication with corresponding male connectors of said four flashing light units, wherein said one of said corresponding male connectors further comprises said electrical communication of said motion switch; and, a battery compartment comprising a means to secure a battery for providing power to said control module, said motion switch, and said four (4) flashing light units secured with an integral flush-mounted and removable cover.

14. The bounce toy of claim 13, wherein said four flashing light units further comprise a string of electrically-connected lamps of one or a variety of decorative colors.

15. The bounce toy of claim 14, wherein said control module may provide any number of illumination sequences and patterns to said four flashing light units thereupon activation thereby said motion switch.

16. The bounce toy of claim 1, wherein said carrying case further comprises a weatherproof transportation means comprising a diameter or width such that said disassembled configuration of said bounce toy and comprising:

a carrying case handle; and, a zipper providing a closure means thereof.

* * * * *